US011702852B2

(12) United States Patent
Bacon et al.

(10) Patent No.: US 11,702,852 B2
(45) **Date of Patent: *Jul. 18, 2023**

(54) ADJUSTABLE BEAM

(71) Applicant: Titan Formwork Systems, LLC, Tempe, AZ (US)

(72) Inventors: David L. Bacon, Tempe, AZ (US); Cody M. J. Ives, Mesa, AZ (US); Michael Q. Hendricks, Rochester, MN (US)

(73) Assignee: Titan Formwork Systems, LLC, Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/524,418

(22) Filed: Nov. 11, 2021

(65) Prior Publication Data

US 2022/0064969 A1 Mar. 3, 2022

Related U.S. Application Data

(63) Continuation of application No. 16/598,153, filed on Oct. 10, 2019, now Pat. No. 11,199,012.

(51) Int. Cl.

| | |
|---|---|
| ***E04G 11/50*** | (2006.01) |
| ***E04C 3/07*** | (2006.01) |
| ***E04C 3/292*** | (2006.01) |

(52) U.S. Cl.

CPC ..... *E04G 11/50* (2013.01); *E04C 3/07* (2013.01); *E04C 3/292* (2013.01); *E04G 2011/505* (2013.01)

(58) Field of Classification Search

CPC ..... E04G 11/50; E04G 2011/505; E04G 2025/006; E04G 11/54; E04G 11/56; E04C 3/07; E04C 3/292

See application file for complete search history.

(56) References Cited

U.S. PATENT DOCUMENTS 2,167,413 A * 7/1939 Bartlett ..... E04G 17/18 52/645

3,034,162 A 5/1962 Smith (Continued)

FOREIGN PATENT DOCUMENTS

DE 10 2004 004883 A1 3/2005

EP 1234929 A1 * 8/2002 ..... E04G 11/486

(Continued)

OTHER PUBLICATIONS

Press Release article titled "Aug. 4, 2019 Hünnebeck Launches Topec DH Slab Formwork System," Hünnebeck, 2019, printed from the internet at <https://www.huennebeck.com/about_us/news/press_releases/?view=2862>, on Aug. 30, 2019, 2 pages.

(Continued)

*Primary Examiner* — Adriana Figueroa

(74) *Attorney, Agent, or Firm* — Shook, Hardy & Bacon L.L.P

(57) ABSTRACT

An adjustable beam may include an elongate member extending between a first end and a second end, a first connector pivotably coupled to the first end, and a second connector pivotably coupled to the second end. The first and second connectors each are configured to be releasably coupled to neighboring supporting beams and other adjustable beams.

17 Claims, 12 Drawing Sheets

(56) References Cited

U.S. PATENT DOCUMENTS

| | | | | |
|---|---|---|---|---|
| 3,376,011 | A | 4/1968 | Petchuk | |
| 3,693,929 | A | 9/1972 | Martin | |
| 4,309,857 | A * | 1/1982 | Lovering | E04G 11/56 52/632 |
| 7,883,296 | B2 | 2/2011 | Meyer | |
| 8,516,762 | B1 | 8/2013 | Jendusa | |
| 8,656,543 | B2 | 2/2014 | Porter et al. | |
| 9,004,443 | B2 | 4/2015 | Zhang | |
| 9,175,472 | B1 | 11/2015 | Calini | |
| 9,180,807 | B2 | 11/2015 | Squyres | |
| 2007/0056222 | A1 | 3/2007 | Buchanan | |
| 2009/0151282 | A1 | 6/2009 | Loayza | |
| 2019/0010717 | A1 | 1/2019 | Baron et al. | |
| 2019/0270400 | A1 | 9/2019 | Da Rosa et al. | |

FOREIGN PATENT DOCUMENTS

| | | | | |
|---|---|---|---|---|
| EP | 3 073 028 A1 | 9/2016 | | |
| EP | 3073028 A1 * | 9/2016 | | E04G 11/56 |
| EP | 2982813 B1 * | 2/2017 | | E04G 11/56 |
| FR | 3000977 A1 * | 7/2014 | | E04G 11/56 |
| JP | 2561410 Y2 * | 7/1991 | | |
| JP | 2561410 Y2 | 1/1998 | | |
| JP | 6306946 B2 | 4/2018 | | |
| WO | WO 95/00727 A1 | 1/1995 | | |

OTHER PUBLICATIONS

Author Unknown, "Efco Deck Shoring System", Published before Oct. 10, 2019, pp. 5 and 10.

Ulma, "Formadeck—Drop Head Shoring System", Published before Oct. 10, 2019, p. 9.

Photograph of Pro-Deck, believed to be in public use before Oct. 10, 2019, 1 page.

Titan HV, "Equipping Builders to Succeed" Brochure, Published before Oct. 10, 2019, 7 pages.

Photographs of Adjustable Beam, believed to be in public use before Oct. 10, 2019, 2 pages.

International Preliminary Report on Patentability from corresponding international application No. PCT /US2020/054383, dated Apr. 12, 2022, 8pp.

* cited by examiner

ADJUSTABLE BEAM

The present patent document is a continuation application that claims the benefit of priority under 35 U.S.C. § 120 of U.S. patent application Ser. No. 16/598,153, filed Oct. 10, 2019, which is hereby incorporated by reference in its entirety.

TECHNICAL FIELD

The present disclosure relates to a beam that may be used for a formwork or shoring system to provide support between neighboring supporting beams for supporting a horizontal surface (e.g. plywood) disposed on top of the beams and for providing lateral support to the formwork or shoring system.

BRIEF SUMMARY OF THE INVENTION

One general aspect of the present disclosure includes an adjustable beam, including an elongate member extending between a first end and a second end; a first connector pivotably coupled to the first end; and a second connector pivotably coupled to the second end, where the first and second connectors each are configured to be releasably coupled to neighboring supporting beams, and where the first and second connectors each are configured to be releasably coupled to other adjustable beams with the same construction.

Another general aspect of the present disclosure includes a kit for establishing a shoring system, including two supporting beams and one or more adjustable beams, where each adjustable beam of the one or more adjustable beams includes an elongate member extending between a first end and a second end, where a first connector is pivotably coupled to the first end, where the first connector is configured to be releasably coupled to and supported by another adjustable beam, and where when the one or more adjustable beams are connected to span across the two supporting beams, a top surface of the one or more adjustable beams is substantially flush with top surfaces of the two supporting beams.

Another general aspect of the present disclosure includes a method for installing a shoring system, including installing two supporting beams and installing one or more adjustable beams, where each adjustable beam of the one or more adjustable beams includes an elongate member extending between a first end and a second end, where a first connector is pivotably coupled to the first end, where a second connector is pivotably coupled to the second end, where the first and second connectors each are configured to be releasably coupled to the two supporting beams, and where the first and second connectors each are configured to be releasably coupled to other adjustable beams.

Other systems, methods, features and advantages of the invention will be, or will become, apparent to one with skill in the art upon examination of the following figures and detailed description. It is intended that all such additional systems, methods, features, and advantages be within the scope of the invention, and be encompassed by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like-referenced numerals designate corresponding parts throughout the different views.

DETAILED DESCRIPTION

Figure 1:
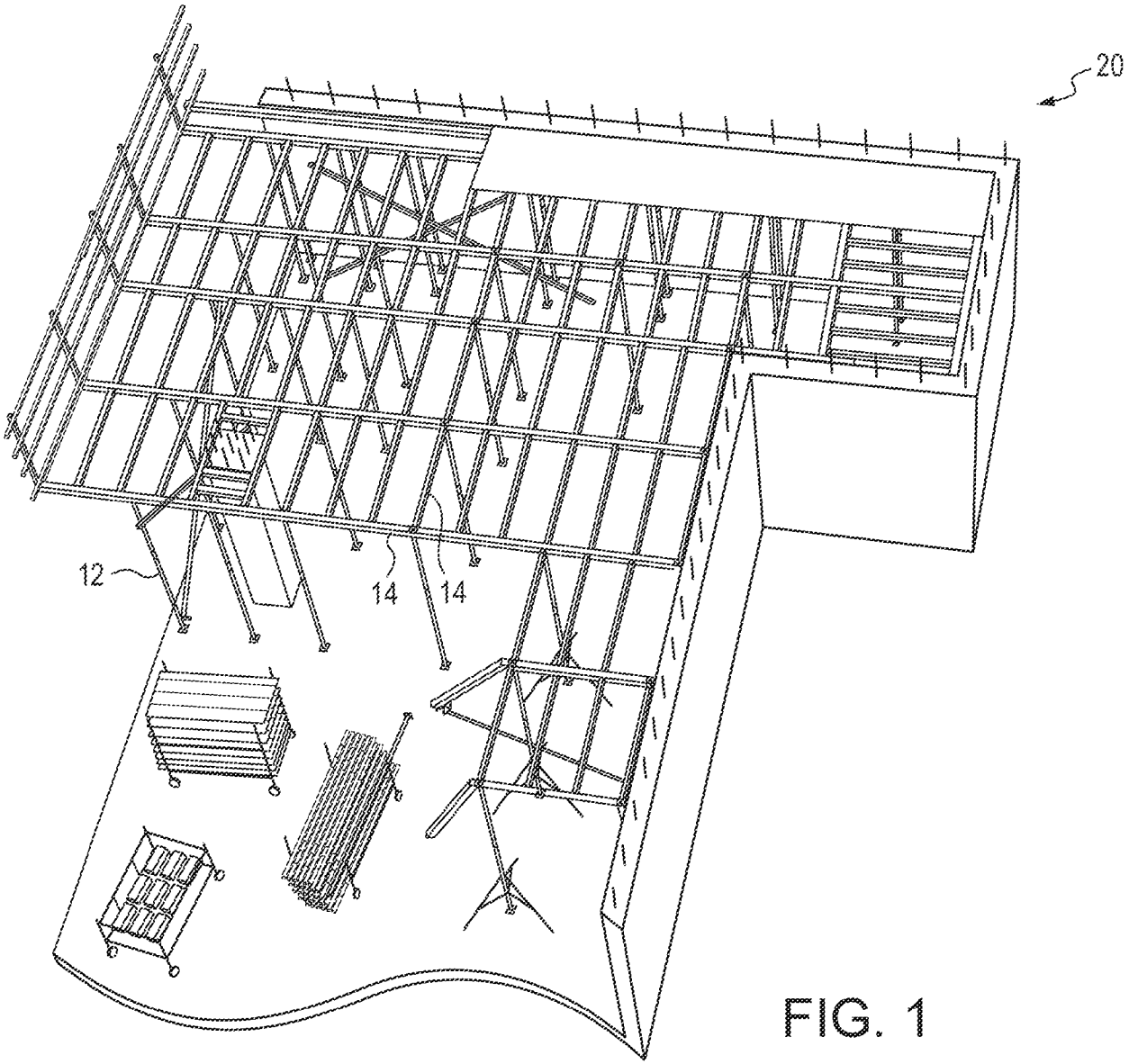
FIG. 1 is a perspective view of a formwork system including shoring posts, supporting beams, and wooden beams in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional material, construction, and assembly.

An adjustable beam 10 used for a formwork system to provide support between neighboring supporting beams for supporting a horizontal surface (e.g. plywood) disposed on top of the beams and for providing lateral support to the formwork system is described with reference to FIGS. 1-12. The term "adjustable beam" is used herein to identify the beam as a whole, and the adjustability of the beam at connecting to other beams at different orientations with respect to each other and with respect to the beam 10, and the adjustability of the end features of the beam with respect to the body of the beam. For the sake of brevity, while an adjustable beam 10 that is configured to span two supporting beams of a formwork system, either by itself or by coupling to one or more other adjustable beams, is specifically depicted and described herein, the adjustable beam 10 may be successfully implemented for spanning other supporting structures (e.g., in a shoring system) to accommodate the various sized and shaped gaps between the supporting structures and to provide desired support. One of ordinary skill in the art, with a thorough review of the subject specification and figures, will readily comprehend how the adjustable beam 10 may be implemented for use with other systems to provide desired support and to accommodate various configurations of the other systems, and will readily comprehend which other systems might be suitable without undue experimentation.

Figure 2:
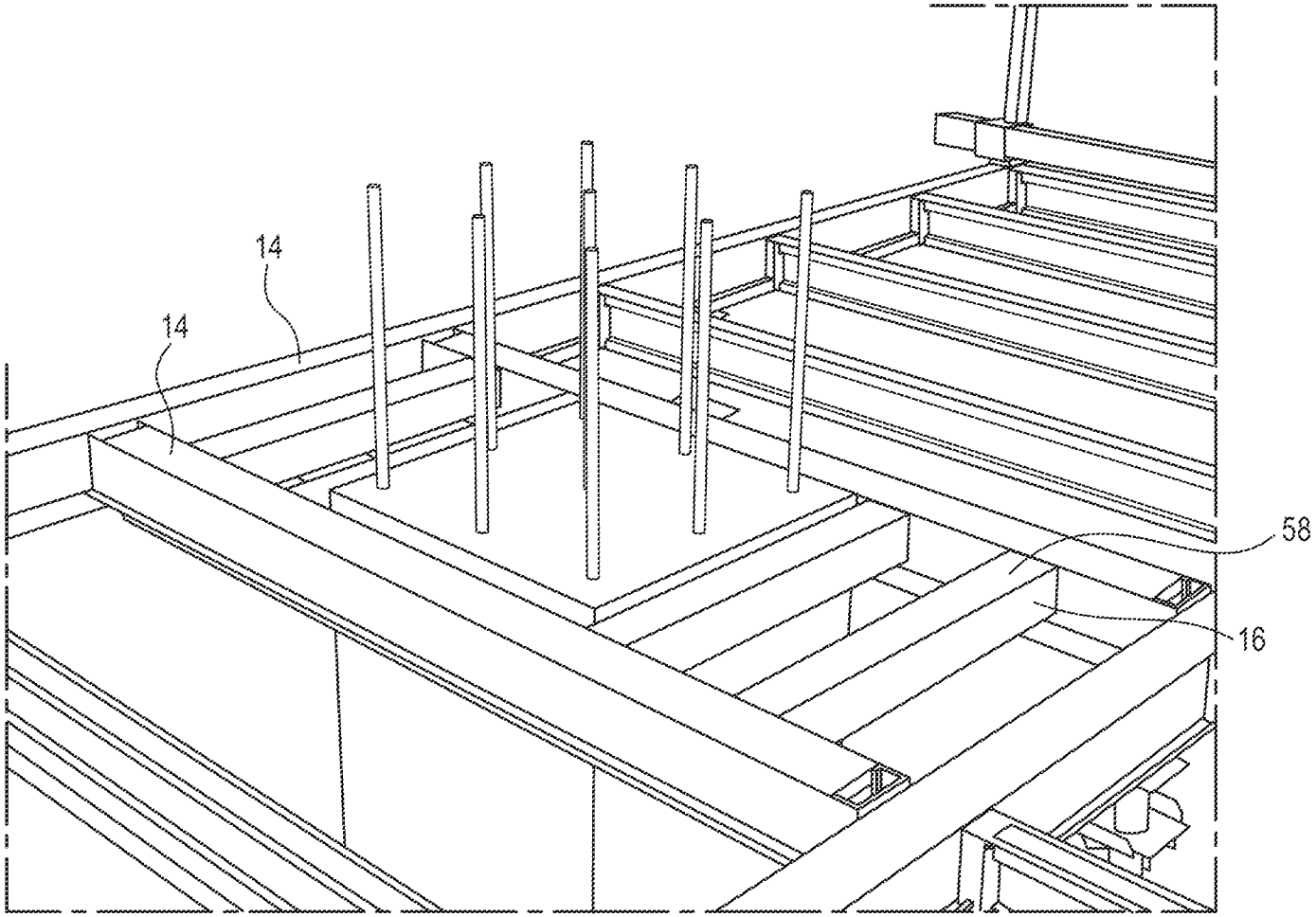
FIG. 2 is an enlarged partial perspective view of the formwork system of FIG. 1, showing a number of wooden beams extending between neighboring supporting beams in accordance with certain aspects of the present disclosure.

Referring to FIGS. 1-2, a formwork system 20 including a plurality of vertically extending shoring posts 12 and a plurality of horizontally extending supporting beams 14 is shown. For purposes of reference, the terms "vertically" and "horizontally" are intended to describe the directions with respect to the floor the shoring posts 12 are disposed upon. The shoring posts 12 and the supporting beams 14 are disposed such that the top surfaces of the supporting beams form a generally flat shoring surface to support, for example, a poured concrete floor thereon (i.e. upon plywood disposed thereon, and to support workers, equipment, and other stories of formwork disposed thereabove).

Conventionally, as shown in FIG. 2, a number of wooden beams 16 (e.g., 2 by 4 or 4 by 4 wooden beams) may be cut and disposed spacingly between neighboring supporting beams 14 such that the top surfaces of the wooden beams 16 are flush with the supporting beams 14 to provide additional generally flat shoring surface to support the objects disposed upon the supporting beams 14. The neighboring supporting beams 14 may be spaced apart different distances and/or disposed at different angles with respect to each other (e.g., parallel or connected at different angles), and thus wooden beams with different configurations (e.g., length, end shapes) may be needed to accommodate the various sized and shaped gaps between neighboring supporting beams. Accordingly, the use of wooden beams increases labor time and costs, material (e.g., wood) costs, and waste. The adjustable beam 10 disclosed herein will provide a reusable beam that can be used to replace all or most of the wooden beams 16, thereby reducing labor time and costs, material costs, and waste.

Figure 3:
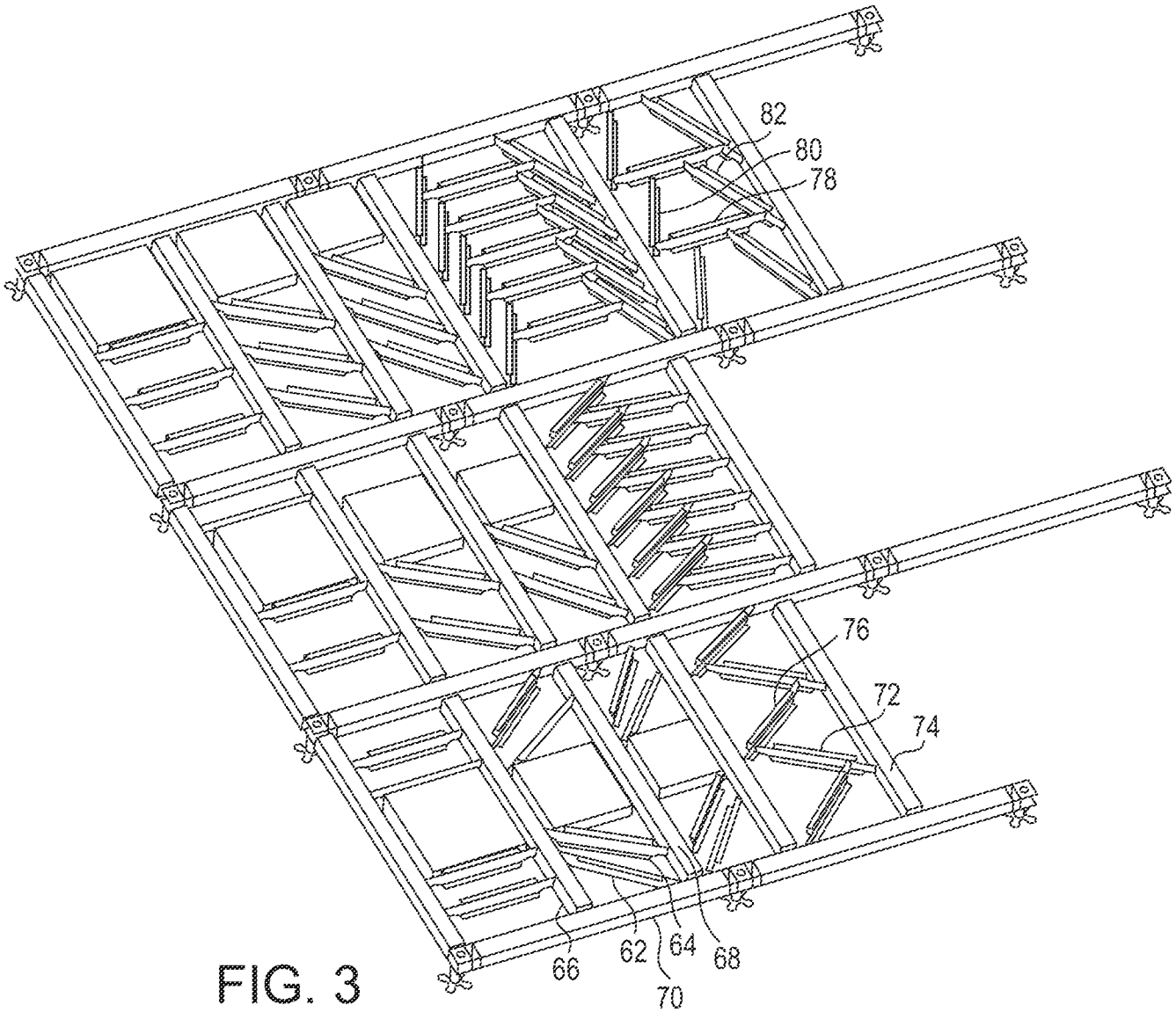
FIG. 3 is a top perspective view of a formwork system including supporting beams and adjustable beams in accordance with certain aspects of the present disclosure.

Referring to FIGS. 3-12, an adjustable beam 10 and methods of installing one or more adjustable beams 10 spanning two neighboring supporting beams 14 are shown. As will be appreciated by one of ordinary skill in the art with a thorough review of FIG. 3 and the remaining portions of the specification and remaining figures, the adjustable beam can be installed between two adjacent supporting beams (e.g., adjustable beam 62 is installed between adjacent supporting beams 66 and 70; adjustable beam 64 is installed between adjacent supporting beams 66 and 68, as shown in FIG. 3) and alternatively can be positioned such that one end connects to a supporting beam and the opposite end connects to another adjustable beam (e.g., one end of the adjustable beam 72 connects to the supporting beam 74 and the opposite end of the adjustable beam 72 connects to another adjustable beam 76, as shown in FIG. 3). Additionally, in some embodiments, both ends of an adjustable beam can connect to other adjustable beams (e.g., both ends of the adjustable beam 78 connect to other adjustable beams 80 and 82). Adjustable beams can be used within an engineered support system to bridge gaps between adjacent supporting beams that are larger or smaller than a length of a single adjustable beam.

Figure 4:
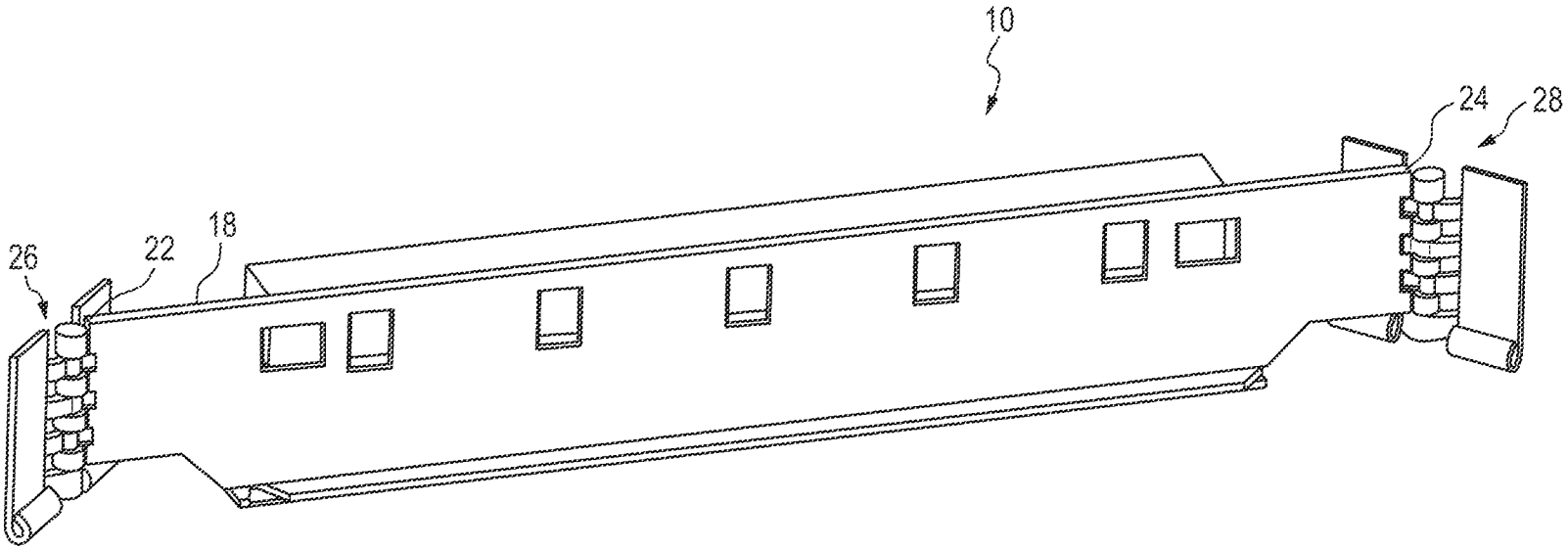
FIG. 4 is a perspective view of an adjustable beam in accordance with certain aspects of the present disclosure.

In some embodiments, as shown in FIG. 4, the adjustable beam 10 includes an elongate member 18 extending between a first end 22 and a second end 24. The elongate member 18 has a fixed length. A first connector 26 is pivotably coupled to the first end 22, and a second connector 28 is pivotably coupled to the second end 24. The first and second connectors 26 and 28 may be configured to pivot independently with respect to the elongate member 18. In this embodiment, the first and second connectors 26 and 28 have the same configuration, and thus for the sake of brevity, when only the configuration of or the methods of using one connector (the first connector 26 or the second connector 28) is specifically described below, it will be appreciated that these descriptions are also applicable to the other connector (the second connector 28 or the first connector 26). In some other embodiments, the first and second connectors may be different, and in some other embodiments, the adjustable beam 10 may only have one connector pivotably coupled to one end of the elongate member 18, and it will be appreciated that these embodiments do not depart from the scope of the present invention.

Figure 5:
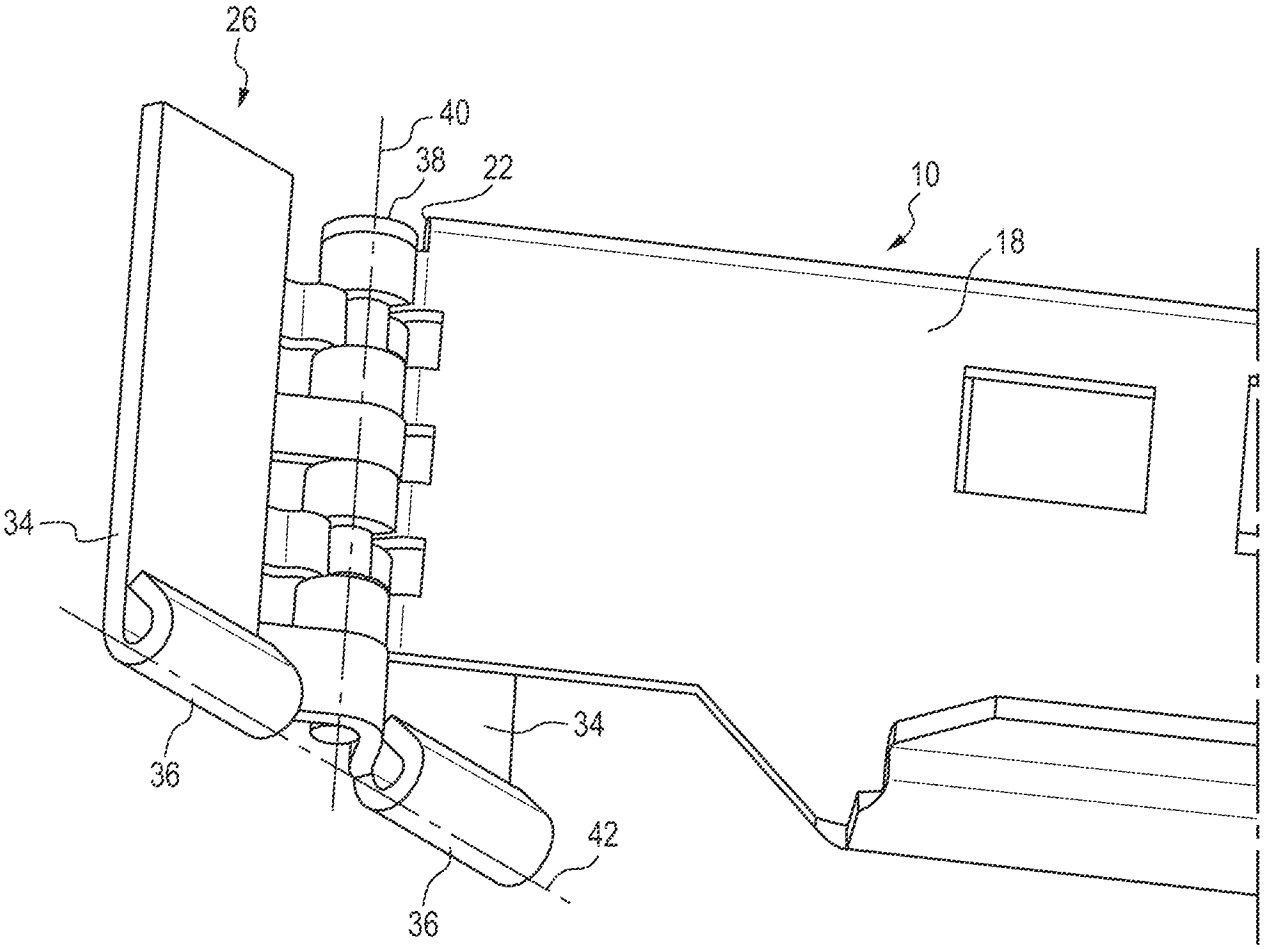
FIG. 5 is an enlarged partial perspective view of the adjustable beam of FIG. 4, showing a portion of the adjustable beam in accordance with certain aspects of the present disclosure.
Figure 6:
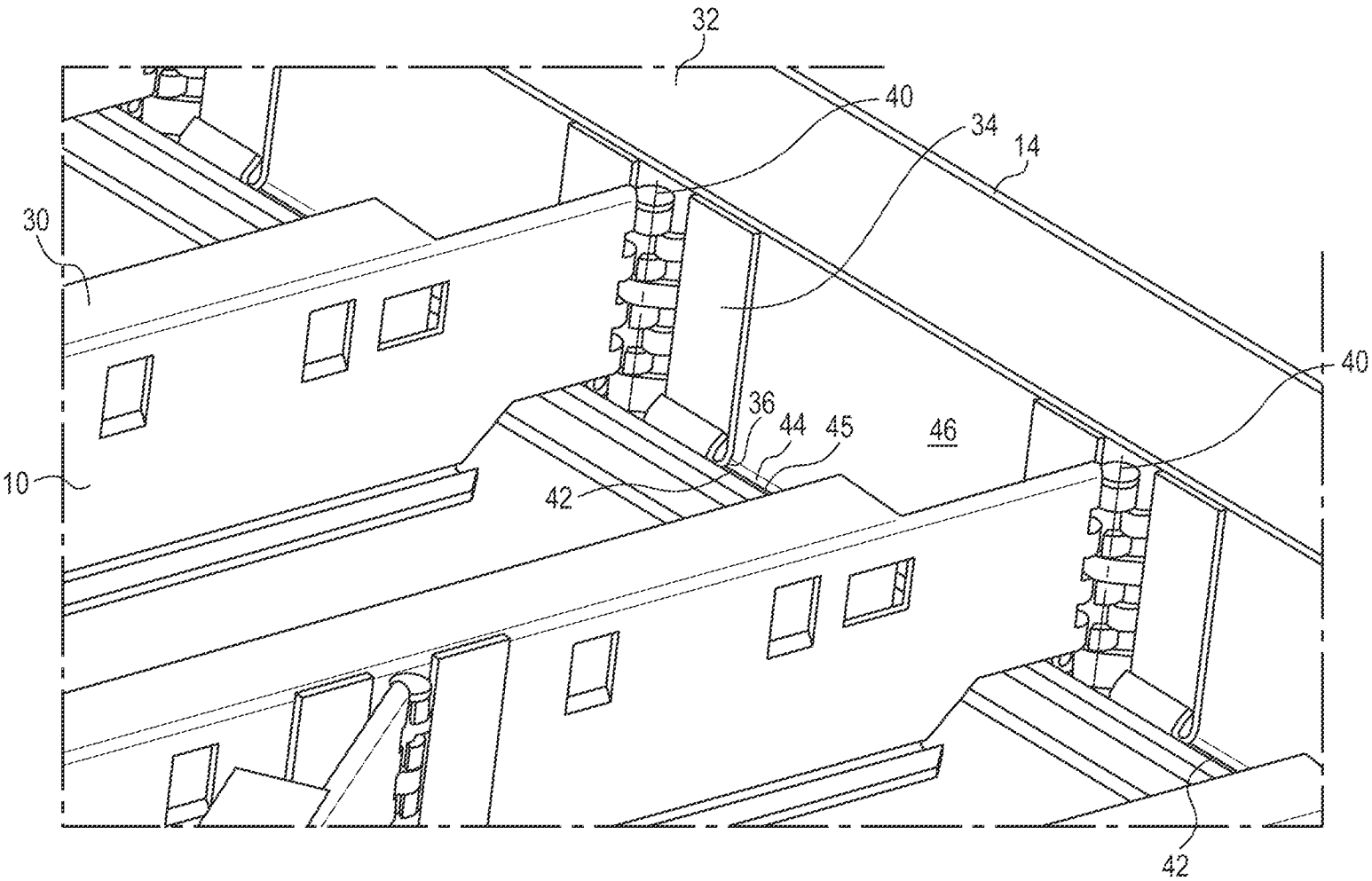
FIG. 6 is a perspective view of a connection between the adjustable beam of FIG. 4 and a supporting beam in accordance with certain aspects of the present disclosure.
Figure 10:
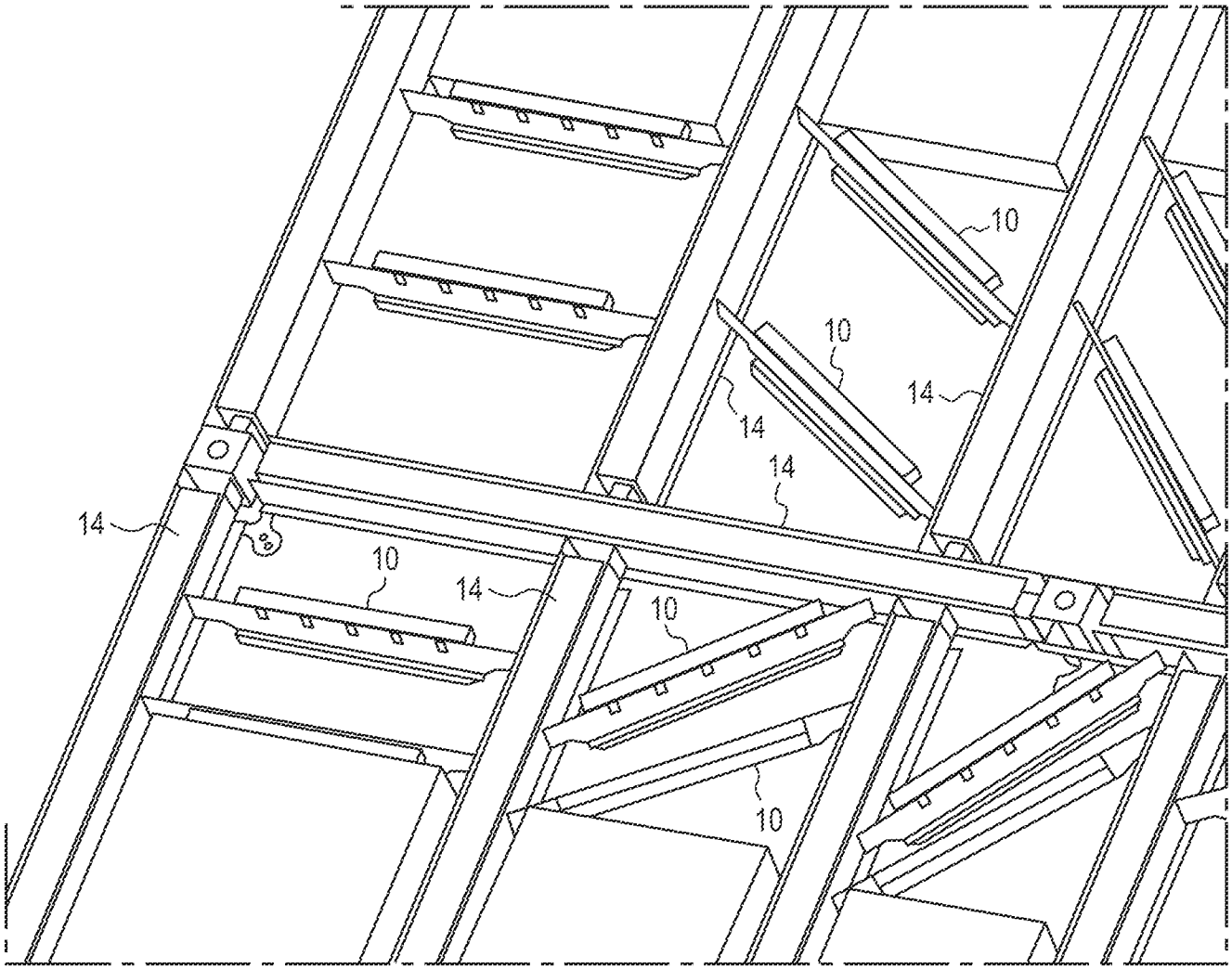
FIG. 10 is a perspective view of the adjustable beam of FIG. 4 installed spanning two supporting beams in accordance with certain aspects of the present disclosure.

Referring to FIGS. 4-6, the first and second connectors 26 and 28 each are configured to be releasably coupled to neighboring supporting beams 14. When the first and second connectors 26 and 28 each are coupled to neighboring supporting beams, a top surface 30 of the adjustable beam 10 is disposed along substantially a same plane as top surfaces 32 of the neighboring supporting beams 14 (e.g., as shown in FIG. 6). The term "substantially a same plane" means a plane within the stacked manufacturing tolerances of the supporting beam and the adjustable beam (e.g., +/−1.0 mm) or within 0.25 inches. In some embodiments, the top surface 30 of the adjustable beam 10 is nailable such that objects (e.g., plywood) disposed upon the top surface 30 may be fastened onto the top surface 30 through nails. As shown in FIG. 5, the first connector 26 includes a bottom portion 36 and an upper portion 34 extending outwardly from the bottom portion 36. The bottom portion 36 is configured to be releasably received in a groove 44 of a supporting beam 14 such that the first and second connectors 26 and 28 can be coupled to the neighboring supporting beams 14 (e.g., as shown in FIGS. 6 and 10). In some embodiments, the bottom portion 36 rests in and contacts the bottom surface 45 of the groove 44. The bottom portion 36 may be rounded (which facilitates easy entry of the bottom portion 36 into the groove 44), square, or have other configurations without departing from the scope of the present invention. The upper portion 34 has a generally flat configuration such that when the bottom portion 36 is received in the groove 44 of the supporting beam 14, the upper portion 34 contacts a side surface 46 of the supporting beam 14 to prevent rolling of the upper portion 34. The dimension of the upper portion 34 may be varied, as desired and/or needed, to provide desired friction between the upper portion 34 and the side surface 46.

As shown in FIG. 5, the first connector 26 is pivotably connected to the first end 22 of the elongate member 18 through a hinge 38, such that the elongate member 18 can pivot about a central axis 40 (i.e., pivot point 40) of the hinge 38 and be positioned a continuous range of possible angles with respect to the first connector 26. Depending on the size, shape and relative configuration of the hinge 38, the first end 22, and the connection therebetween, the range of the angles may be varied. In some embodiments, the range of the angles may be between about 10 degrees and about 170 degrees. The term "about" is specifically defined herein to include the specific value referenced as well as a dimension that is within 5% of the dimension both above and below the dimension. One of ordinary skill in the art with a thorough review and understanding of this specification will readily comprehend that the possible range of angles is a function of the length of the first end, the cross-section of the elongate member (both proximate to the pivot point of the hinge 38 and extending therefrom) and the cross-section of the beam that will receive the first end 22. In some embodiments, the bottom edge 42 (i.e., load bearing point 42) of the bottom portion 36 and the central axis 40 (i.e., pivot point 40) of the hinge 38 may be vertically aligned (e.g., T-shape as shown in FIGS. 5 and 6) such that when the bottom portion 36 is received within the groove 44 of the supporting beam 14, the hinge 38 is also above the groove 44. This configuration is advantageous for removing the tendency of the adjustable beam 10 to roll off the groove 44 of the supporting beam 14 due to eccentric loads (e.g., a vertical downward force applied to the elongate member 18). This configuration is also advantageous for allowing for more room for the rotation of the elongate member 18 of the adjustable beam 10, and thus allowing for a larger range of angles that the elongate member 18 can be positioned with respect to the supporting beam 14), thereby allowing the adjustable beam 10 with a fixed length (e.g., either by itself or by coupling to one or more other adjustable beams) to accommodate a greater number of different sized and shaped gaps between neighboring supporting beams 14.

Figure 7:
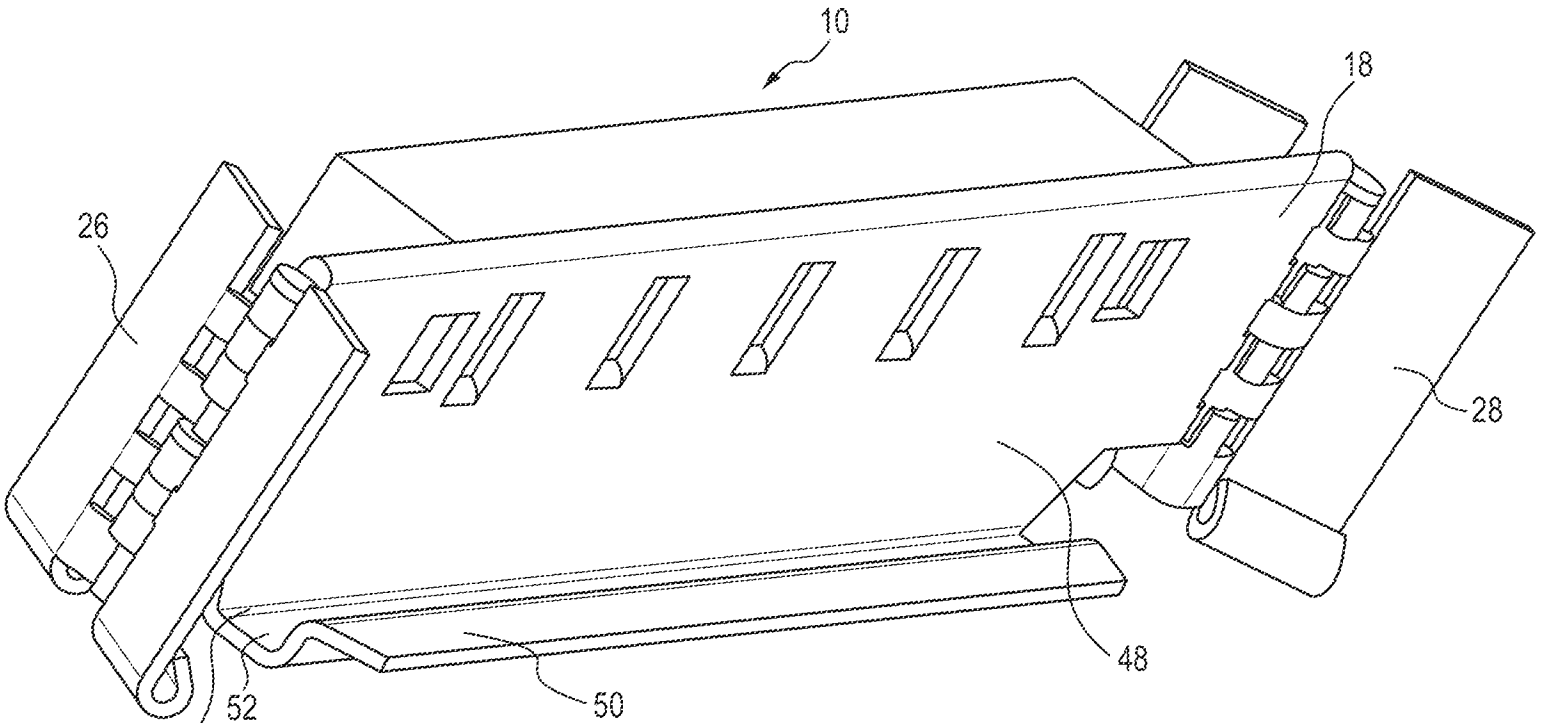
FIG. 7 is another perspective view of the adjustable beam of FIG. 4 in accordance with certain aspects of the present disclosure.
Figure 8:
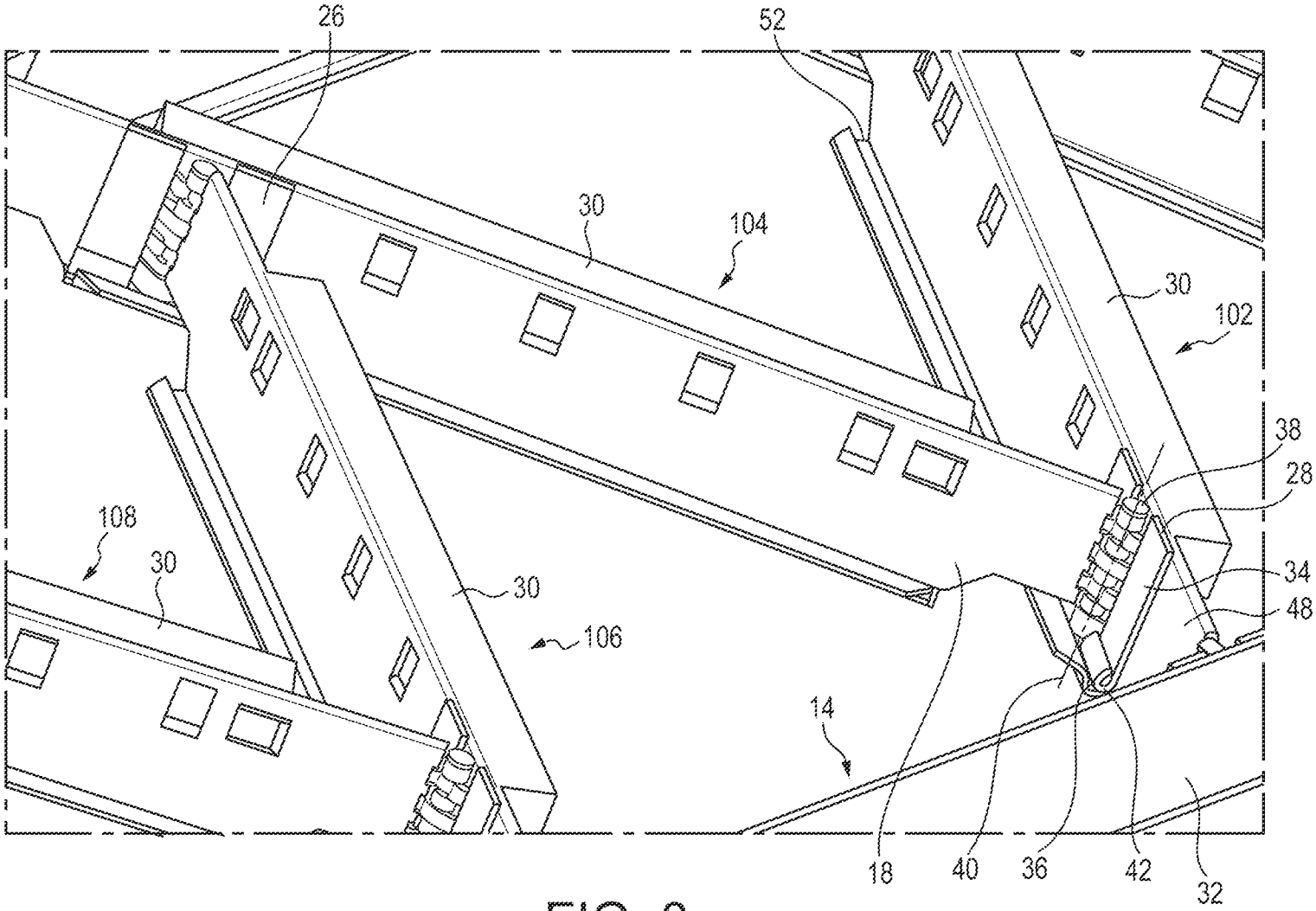
FIG. 8 is a perspective view of a connection between two adjustable beams of FIG. 4 in accordance with certain aspects of the present disclosure.
Figure 9:
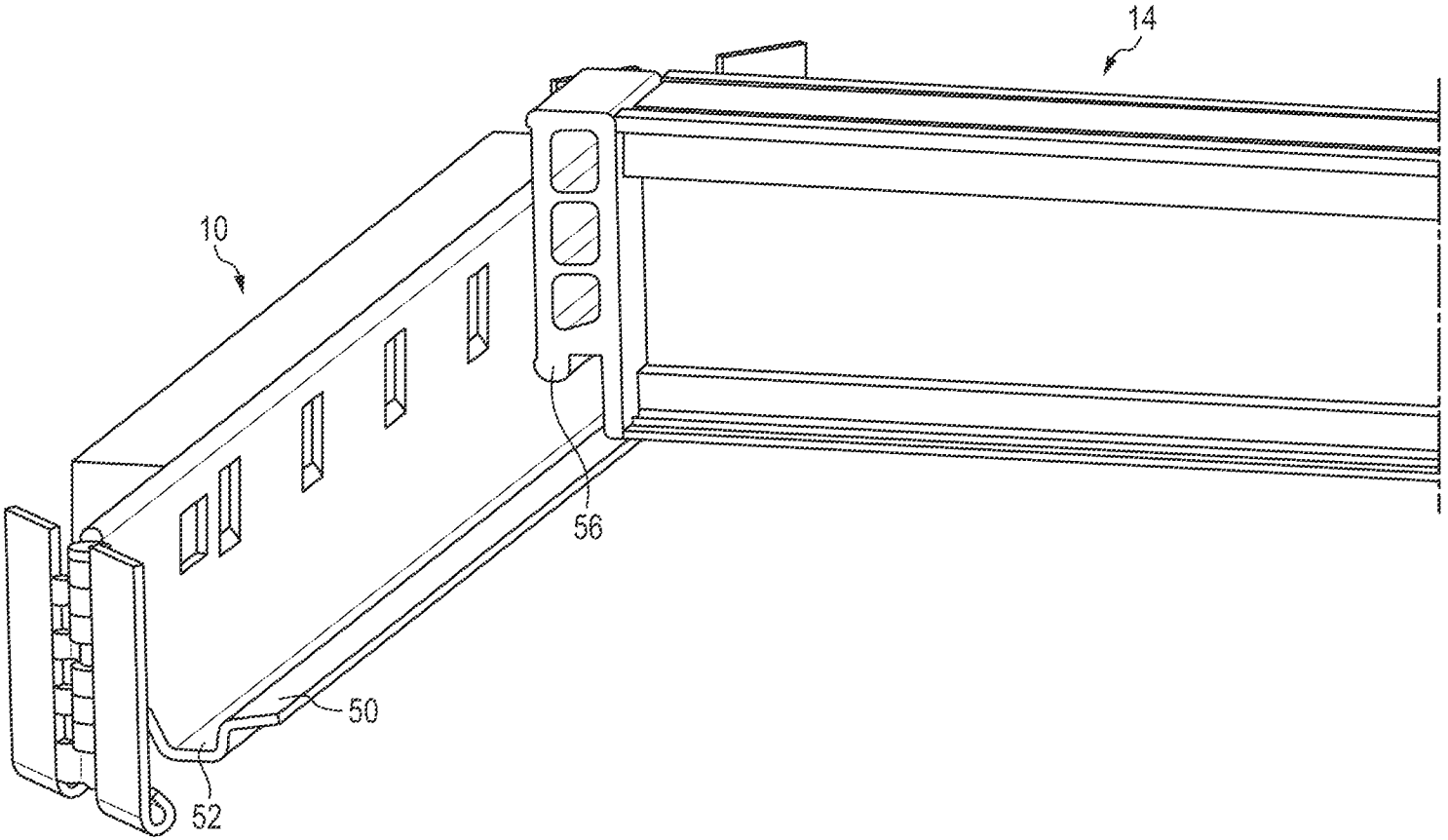
FIG. 9 is a perspective view of the adjustable beam of FIG. 4 and a supporting beam, showing that the supporting beam cannot be coupled to the adjustable beam, in accordance with certain aspects of the present disclosure.
Figure 12:
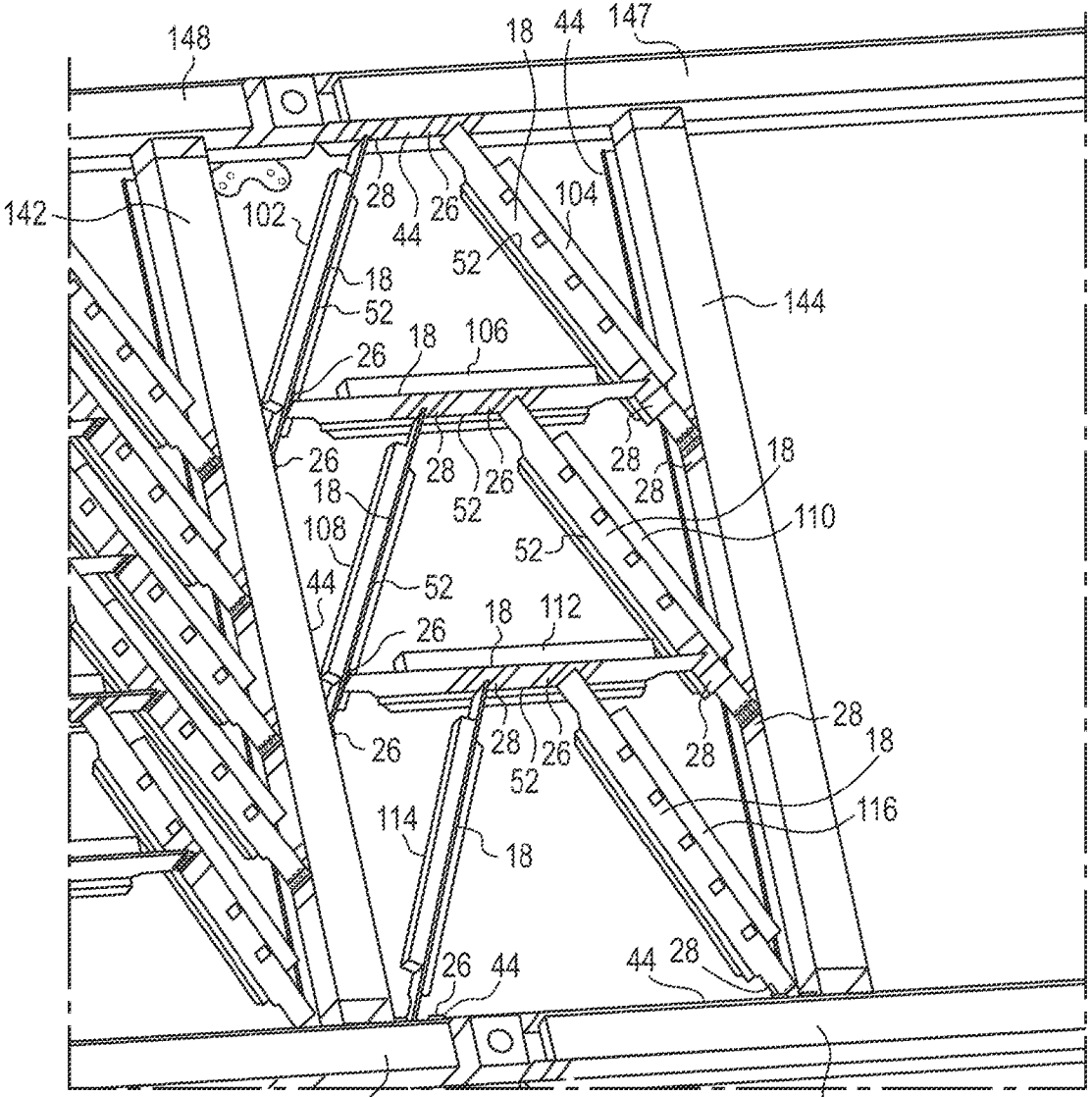
FIG. 12 is a perspective view of three adjustable beams of FIG. 4 coupled together and installed spanning two supporting beams in accordance with certain aspects of the present disclosure.

Referring to FIGS. 7-9, the first and second connectors 26 and 28 of one adjustable beam each are configured to be releasably coupled to and supported by other adjustable beams with the same construction (e.g., as shown in FIG. 12, adjustable beams 102-106 have the same construction/configuration (e.g., all the features of the adjustable beams 102-106 are the same) and the first and second connectors 26 and 28 of the adjustable beam 106 are releasably coupled to the adjustable beams 102 and 104, respectively). As shown in FIG. 7, the elongate member 18 includes a side surface 48 including a flange 50 connected to a bottom edge 54 of the side surface 48 with a recess 52 disposed between the flange 50 and the bottom edge 54. The recess 52 extends along at least a portion of the length of the elongate member 18 and is configured to releasably receive a bottom portion of a connector (e.g., a first connector 26 or a second connector 28) of another adjustable beam 10 such that two or more adjustable beams 10 can be coupled together (e.g., as shown in FIG. 8). The recess 52 is configured such that the connector 26 or 28 of another adjustable beam 10 can be coupled to the adjustable beam 10 anywhere along the length of the recess 52.

Figure 11:
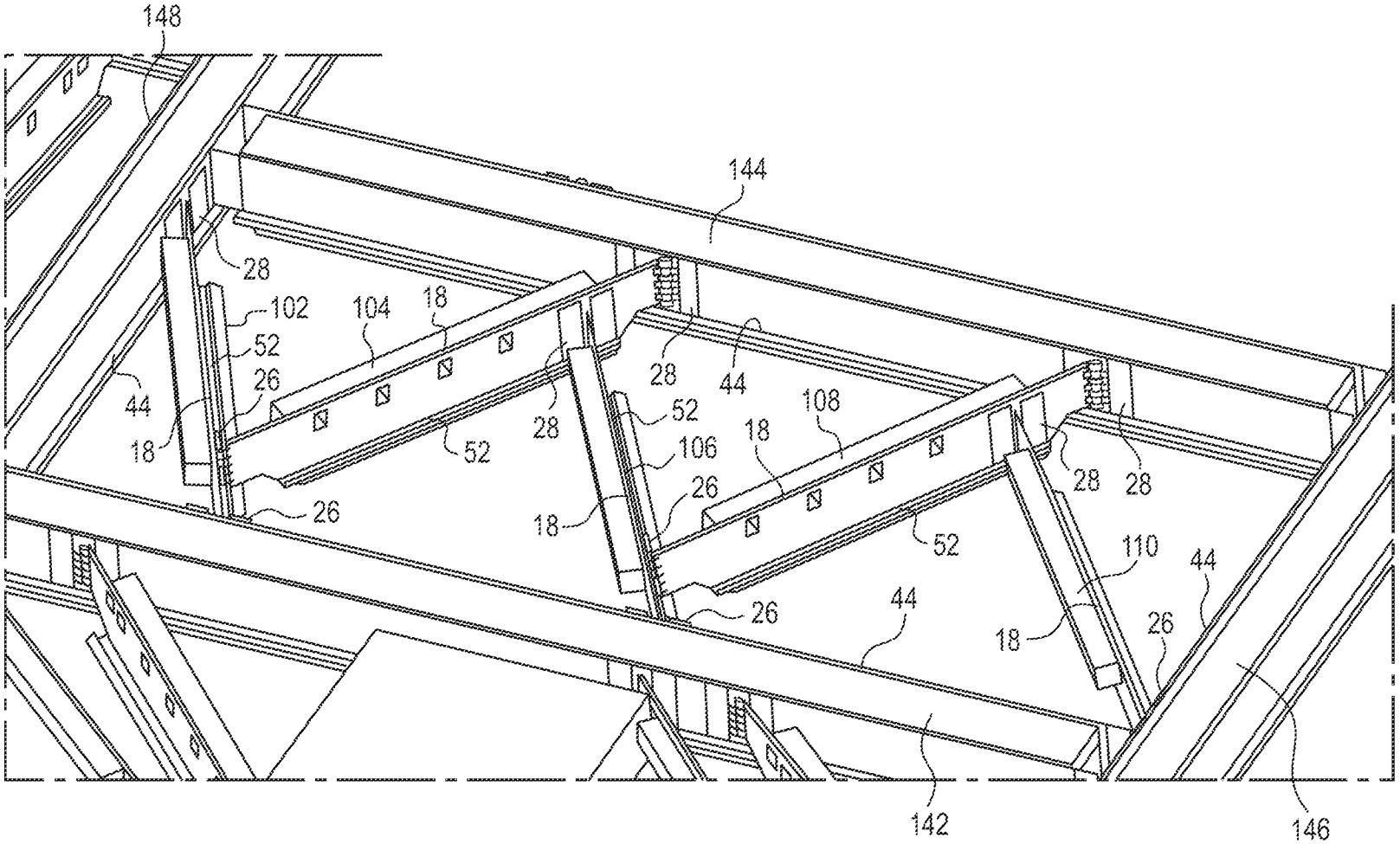
FIG. 11 is a perspective view of two adjustable beams of FIG. 4 coupled together and installed spanning two supporting beams in accordance with certain aspects of the present disclosure.

Similar to the connection between the connector 26 or 28 of the adjustable beam 10 and the supporting beam 14, as shown in FIGS. 8 and 11-12, when two or more adjustable beams (e.g., 102-108 as shown in FIG. 8) are coupled together, the top surfaces 30 of the adjustable beams are disposed along substantially a same plane as top surfaces 32 of the neighboring supporting beams 14. As shown in FIG. 8, when the bottom portion 36 of a second connector 28 of a second adjustable beam 104 is received in the recess 52 of a first adjustable beam 102, the upper portion 34 of the second connector 28 of the second adjustable beam 104 contacts a side surface 48 of the first adjustable beam 102 such that the upper portion 34 is prevented from rolling off the recess 52.

In addition, as discussed above, in embodiments where the bottom edge 42 (i.e., load bearing point 42) of the bottom portion 36 of the second connector 28 and the central axis 40 (i.e., pivot point 40) of the hinge 38 are vertically aligned, such that when the bottom portion 36 of the second connector 28 of the second adjustable beam 104 is received in the recess 52 of the first adjustable beam 102 (e.g., as shown in FIG. 8), the hinge 38 is also above the recess 52. As discussed above, this configuration is advantageous for removing the tendency of the second adjustable beam 104 to roll off the recess 52 of the first adjustable beam 102 due to eccentric loads (e.g., a vertical downward force applied to the elongate member 18 of the second adjustable beam 104). This configuration is also advantageous for allowing for more room for the rotation of the elongate member 18 of the second adjustable beam 104, and thus allowing for a larger range of angles that the elongate member 18 of the second adjustable beam 104 can be positioned with respect to the first adjustable beam 102, thereby allowing one or more adjustable beams, each with a fixed length, to be coupled together to accommodate a greater number of different sized and shaped gaps between neighboring supporting beams 14, as discussed in greater detail below.

As shown in FIG. 9, the recess 52 and the flange 50 may be configured (e.g., the recess 52 is too deep to allow a finger 56 of a supporting beam 14 to be received therein) such that other supporting beams constructed differently than the adjustable beam (e.g., the supporting beams 14) cannot be coupled to the adjustable beam 10 with a result that the respective top surfaces of the adjustable beam 10 and the supporting beam 14 are along substantially a same plane. Specifically, a finger 56 of a conventional supporting beam cannot be placed within the recess 52 of an adjustable beam 10. In other words, only adjustable beams 10 can be coupled to other adjustable beams 10. This configuration is advantageous for reducing or removing the possibility of overloading the adjustable beams either through design or via improper assembly of an engineered system including adjustable beams 10. The recess 52 and the flange 50 are also configured such that one or more wooden beams 16 (e.g., 2 by 4 or 4 by 4 wooden beams, as shown in FIG. 2) can be disposed upon the flange 50, extending between neighboring adjustable beams 10, with top surfaces 58 (e.g., as shown in FIG. 2) of the wooden beams 16 being substantially flush with top surfaces 30 of the neighboring adjustable beams 10, and being substantially flush with top surfaces 32 of the supporting beams 14 that the adjustable beams 10 are coupled to. The term "substantially flush with" is used to describe surfaces that are along "substantially a same plane," as defined above. This configuration is advantageous for providing additional generally flat shoring surface to support the objects disposed above the supporting beams 14.

In use, to install/establish a formwork or shoring system, a kit including at least two supporting beams 14 and one or more adjustable beams 10 may be used. The one or more adjustable beams 10 are configured to be installed spanning two neighboring supporting beams 14 after the supporting beams 14 are installed in a desired position. Referring to FIGS. 3 and 10-12, two neighboring supporting beams 14 may be disposed with respect to each other in parallel or at an angle with respect to each other. Similarly, the two supporting beams 14 may be positioned a distance away from each other that corresponds to the overall length of the adjustable beam 10, such that an adjustable beam 10 rests within the groove 44 of each of the supporting beams 14 with the adjustable beam 10 disposed substantially perpendicular to both supporting beams 14. The term "substantially perpendicular" is specifically defined herein to include 90 degrees as well as a continuous range of angles between 85 degrees and 95 degrees. Alternatively, the supporting beams 14 may be spaced apart various distances that are shorter than the length of the adjustable beam 10 such that the adjustable beams 10 that span therebetween are disposed at acute/obtuse angles with respect to axes through the supporting beams 14. Further, the supporting beams 14 may be spaced apart a distance that is greater than the length of the adjustable beam 10 such that two or more adjustable beams 10 are connected together as discussed herein to span the two supporting beams 14. The supporting beams 14 may be positioned with respect to each other in a non-parallel relationship such that adjacent adjustable beams 10 (or in some embodiments sets of adjustable beams 10 that are needed to span the adjacent supporting beams 14) are not disposed in parallel to each other. In some embodiments, for adjustable beams that are about 28 inches long, the adjustable beam may, either by itself or by coupling to other adjustable beams, span adjacent supporting beams 14 that are spaced apart between about 10 inches and about 45 inches. Depending on the various sized and shaped gaps between the neighboring supporting beams 14, different numbers (e.g., one, two, or three) of adjustable beams 10 may be installed (e.g., coupled together and positioned within the gaps) to span two neighboring supporting beams 14.

In some embodiments, as shown in FIG. 10, where one adjustable beam 10 is needed to span two neighboring supporting beams 14, to install the formwork or shoring system, a user may first install two neighboring supporting beams 14 in a desired location, and then install an adjustable beam 10 by coupling the first and second connectors 26 and 28 of the adjustable beam 10 to respective grooves 44 of the two neighboring supporting beams 14. Using the same method, a number of adjustable beams 10 may be installed spacingly between the two neighboring supporting beams 14. Depending on the distance and connection between the two neighboring supporting beams 14, the elongate member 18 of the adjustable beam 10 may be positioned generally perpendicular to the two neighboring supporting beams 14 that extend generally in parallel to each other (e.g., where the two neighboring supporting beams 14 are disposed about 24 inches apart) or extend at various angles with respect to the two neighboring supporting beams 14 that are connected at an angle or generally parallel (e.g., where the two neighboring supporting beams 14 are generally parallel and disposed about 10 inches to about 28 inches apart). In some embodiments, the angles may be between about 10 degrees and about 170 degrees, for example between about 18 degrees and about 153 degrees. It will be appreciated that the range of the angles may be varied, as desired and/or needed, to accommodate different configurations of the formwork system 20 (e.g., the distance between neighboring supporting beams 14), without departing from the scope of the present invention.

In some embodiments, as shown in FIG. 11, where two adjustable beams 10 are needed to span two neighboring supporting beams 14 (e.g., where two neighboring supporting beams 14 are spaced about 28 inches to about 36 inches apart), the user may first install the supporting beams 14 and then install two or more adjustable beams 10 within the gap created between the supporting beams 14 with the adjustable beams 10 coupled together. For example, to install the formwork or shoring system as shown in FIG. 11, the user may first install the supporting beams 146 and 148 and then couple the supporting beams 142 and 144 to the supporting beams 146 and 148 such that the supporting beams 142 and 144 extend between the supporting beams 146 and 148.

Then, the user may couple the first connector 26 of the first adjustable beam 102 to the supporting beam 142 and couple the second connector 28 of the first adjustable beam 102 to the supporting beam 148 at desired locations along the length of the grooves 44 of the respective supporting beams 142 and 148. Then, the user may couple the second connector 28 of the second adjustable beam 104 to the supporting beam 144 at a desired location along the length of the groove 44 of the supporting beam 144 and couple the first connector 26 of the second adjustable beam 104 to the first adjustable beam 102 at a desired location along the length of the recess 52 of the first adjustable beam 102. Then, the user may couple the first connector 26 of the third adjustable beam 106 to the supporting beam 142 at a desired location along the length of the groove 44 of the supporting beam 142 and couple the second connector 28 of the third adjustable beam 106 to the second adjustable beam 104 at a desired location along the length of the recess 52 of the second adjustable beam 104.

Then, the user may couple the second connector 28 of the fourth adjustable beam 108 to the supporting beam 144 at a desired location along the length of the groove 44 of the supporting beam 144 and couple the first connector 26 of the fourth adjustable beam 108 to the third adjustable beam 106 at a desired location along the length of the recess of the third adjustable beam 106. Then, the user may couple the first connector 26 of the fifth adjustable beam 110 to the supporting beam 146 at a desired location along the length of the groove 44 of the supporting beam 146 and couple the second connector 28 of the fifth adjustable beam 110 to the fourth adjustable beam 108 at a desired location along the length of the recess 52 of the fourth adjustable beam 108.

As shown in FIG. 11, the elongate members 18 of the adjustable beams 102-110 each are positioned at various angles with respect to other adjustable beams and the supporting beams. In some embodiments, the angles may be between about 10 degrees and about 170 degrees, for example between about 18 degrees and about 153 degrees. It will be appreciated that the range of the angles may be varied, depending on the configuration of the gap 60 (e.g., size, shape) and the number and configuration of the adjustable beams (e.g., length), without departing from the scope of the present invention. The adjustable beams 102-110 coupled together and coupled to the supporting beams 142-148 provide lateral support to the formwork system 20 and provide support between the neighboring supporting beams 142-148 for supporting objects disposed above the supporting beams 142-148. It will be appreciated that the method of installing the formwork or shoring system described above is for illustrative purposes only. One of ordinary skill in the art, with a thorough review of the above description, will readily comprehend that the number of adjustable beams needed and the order of the assembly may be varied depending on the configuration (e.g., length) of the adjustable beams and the size, shape, and relative configuration of the gap between the supporting beams.

In some embodiments, as shown in FIG. 12, where three adjustable beams 10 are needed or desired to span two neighboring supporting beams 14 (e.g., where two neighboring supporting beams 14 are spaced above about 36 inches apart) and to minimize the gaps in horizontal support that would be present if the span bridged by two adjustable beams 10, the user may first install the supporting beams 14 and then install the adjustable beams 10 within the gap created between the supporting beams 14 with the adjustable beams coupled together. For example, to install the formwork or shoring system as shown in FIG. 12, the user may first install the supporting beams 145, 146, 147, and 148, and then couple the supporting beams 142 and 144 to the supporting beams 146 and 148, and supporting beams 145 and 147, respectively, such that the supporting beam 142 extends between the supporting beams 146 and 148 and the supporting beam 144 extends between the supporting beams 145 and 147.

Then, the user may couple the first connector 26 of the first adjustable beam 102 to the supporting beam 142 and couple the second connector 28 of the first adjustable beam 102 to the supporting beam 147 at desired locations along the length of the grooves 44 of the respective supporting beams 142 and 147. Then, the user may couple the first connector 26 of the second adjustable beam 104 to the supporting beam 147 and couple the second connector 28 of the second adjustable beam 104 to the supporting beam 144 at desired locations along the length of the grooves 44 of the respective supporting beams 147 and 144. Then, the user may couple the first connector 26 of the third adjustable beam 106 to the first adjustable beam 102 and couple the second connector 28 of the third adjustable beam 106 to the second adjustable beam 104 at desired locations along the length of the recesses 52 of the respective adjustable beams 102 and 104.

Then, the user may couple the first connector 26 of the fourth adjustable beam 108 to the supporting beam 142 at a desired location along the length of the groove 44 of the supporting beam 142 and couple the second connector 28 of the fourth adjustable beam 108 to the third adjustable beam 106 at a desired location along the length of the recess 52 of the third adjustable beam 106. Then, the user may couple the first connector 26 of the fifth adjustable beam 110 to the third adjustable beam 106 at a desired location along the length of the recess 52 of the third adjustable beam 106 and couple the second connector 28 of the fifth adjustable beam 110 to the supporting beam 144 at a desired location along the length of the groove 44 of the supporting beam 144. Then, the user may couple the first connector 26 of the sixth adjustable beam 112 to the fourth adjustable beam 108 and couple the second connector 28 of the sixth adjustable beam 112 to the fifth adjustable beam 110 at desired locations along the length of the recesses 52 of the respective adjustable beams 108 and 110.

Then, the user may couple the first connector 26 of the seventh adjustable beam 114 to the supporting beam 146 at a desired location along the length of the groove 44 of the supporting beam 146 and couple the second connector 28 of the seventh adjustable beam 114 to the sixth adjustable beam 112 at a desired location along the length of the recess 52 of the sixth adjustable beam 112. Then, the user may couple the first connector 26 of the eighth adjustable beam 116 to the sixth adjustable beam 112 at a desired location along the length of the recess 52 of the sixth adjustable beam 112 and couple the second connector 28 of the eighth adjustable beam 116 to the supporting beam 145 at a desired location along the length of the groove 44 of the supporting beam 145.

As shown in FIG. 12, the elongate members 18 of the adjustable beams 102-116 each are positioned at various angles with respect to other adjustable beams and the supporting beams 142-148. In some embodiments, the angles may be between about 10 degrees and about 170 degrees, for example between about 18 degrees and about 147 degrees. It will be appreciated that the range of the angles may be varied, depending on the configuration of the gap 60 (e.g., size, shape) and the number and configuration of the adjustable beams (e.g., length), without departing from the scope of the present invention. The adjustable beams 102-116 coupled together and coupled to the supporting beams 142-148 provide lateral support to the formwork system 20 and provide support between the neighboring supporting beams 142-148 for supporting objects disposed above the supporting beams 142-148. It will be appreciated that the method of installing the formwork or shoring system described above is for illustrative purposes only. One of ordinary skill in the art, with a thorough review of the above description, will readily comprehend that the number of adjustable beams needed and the order of the assembly may be varied depending on the configuration (e.g., length) of the adjustable beams and the size, shape and relative configuration of the gap between the supporting beams.

While various embodiments of the present disclosure have been described, the present disclosure is not to be restricted except in light of the attached claims and their equivalents. One skilled in the relevant art will recognize that numerous variations and modifications may be made to the embodiments described above without departing from the scope of the present invention, as defined by the appended claims. Moreover, the advantages described herein are not necessarily the only advantages of the present disclosure and it is not necessarily expected that every embodiment of the present disclosure will achieve all of the advantages described.

We claim:

1. An adjustable beam, comprising: an elongate member comprising a fixed length extending between a first end and a second end;

a first connector pivotably coupled to the first end; and a second connector coupled to the second end, wherein the first and second connectors each are configured to be releasably coupled to supporting beams, wherein the adjustable beam has a surface configured to receive at least a first or second connector of another adjustable beam having a similar configuration to the adjustable beam, such that when the adjustable beam and the other adjustable beam are coupled together, top surfaces of the adjustable beam and the other adjustable beam are disposed along substantially a same plane as each other, and wherein the top surface of the adjustable beam is free of overlap with the other adjustable beam, and the top surface of the other adjustable beam is free of overlap with the adjustable beam.

2. The adjustable beam of claim 1, wherein when the first and second connectors each are coupled to the supporting beams, the top surface of the adjustable beam is disposed along substantially a same plane as top surfaces of the supporting beams couplingly receiving the respective first or second connector.

3. The adjustable beam of claim 1, wherein the top surface of the adjustable beam is nailable.

4. The adjustable beam of claim 1, wherein each of the first and second connectors includes a bottom portion and an upper portion extending outwardly from the bottom portion, and wherein the bottom portion is configured to be releasably received in a groove of one of the supporting beams such that the first and second connectors can be coupled to the neighboring supporting beams.

5. The adjustable beam of claim 4, wherein the upper portion is configured such that when the bottom portion is received in the groove of one of the supporting beams, the upper portion contacts a side surface of the supporting beam to prevent rolling of the upper portion.

6. The adjustable beam of claim 1, wherein each of the first and second connectors includes a load bearing point and a pivot point, and wherein the load bearing point has a main longitudinal axis that intersects with a vertical axis of the pivot point.

7. The adjustable beam of claim 1, wherein the elongate member includes a side surface including a flange connected to a bottom edge of the side surface with a recess disposed between the flange and the bottom edge, and wherein the recess extends along a length of the elongate member and is configured to releasably receive a bottom portion of a connector of the other adjustable beam such that two or more of the adjustable beams can be coupled together.

8. The adjustable beam of claim 7, wherein the recess is configured such that the connector of another the other adjustable beam can be coupled to the adjustable beam anywhere along the length of the recess.

9. The adjustable beam of claim 7, wherein the recess is configured to disallow another supporting beam constructed differently than the adjustable beam to be coupled to the adjustable beam.

10. The adjustable beam of claim 7, wherein the recess and flange are configured such that a wooden beam can be disposed thereupon, extending between the adjustable beams, with a top surface of the wooden beam being substantially flush with top surfaces of the adjustable beams.

11. The adjustable beam of claim 1, wherein the second connector is pivotably coupled to the second end.

12. The adjustable beam of claim 1, wherein the first and second connectors each are configured to be releasably coupled to other adjustable beams.

13. An adjustable beam, comprising:

an elongate member extending between a first end and a second end;

a first connector coupled, via a hinge, to the first end, wherein the hinge comprises a pivot axis; and a second connector coupled to the second end, wherein the first and second connectors each are configured to be releasably coupled to neighboring supporting beams, such that when the first connector is received in a groove of a neighboring supporting beam, the pivot axis of the hinge intersects with the groove, and wherein the elongate member has upper and lower ends, and a flange extending outward from a side surface of the elongate member, wherein the flange is positioned beneath the upper end of the elongate member and is configured to receive a portion of another adjustable beam having a similar configuration to the adjustable beam.

14. The adjustable beam of claim 13, wherein the flange is positioned closer to the lower end of the elongate member than the upper end of the elongate member.

15. An adjustable beam for at least partially spanning a distance between a first supporting beam and a second supporting beam, the adjustable beam comprising:

an elongate member extending between a first end and a second end, wherein the adjustable beam comprises a length between the first end and the second end that is shorter than the distance;

a first connector coupled to the first end and releasably attachable to the first supporting beam; and a second connector coupled to the second end and releasably attachable to a second adjustable beam having a similar configuration to the adjustable beam, which is attachable to the second supporting beam, such that the combination of the adjustable beam and the second adjustable beam span the distance, wherein the adjustable beam has a surface configured to receive at least a first or second connector of a third adjustable beam having a similar configuration to the adjustable beam, and wherein top surfaces of the adjustable beam, the second adjustable beam, and the third adjustable beam are substantially planar along their lengths.

16. The adjustable beam of claim 15, wherein the first connector is pivotably coupled to the first end.

17. The adjustable beam of claim 15, wherein the elongate member has upper and lower ends, and a flange extending outward from a side surface of the elongate member, wherein the flange is positioned beneath the upper end of the elongate member and is configured to receive a portion of another adjustable beam having a similar configuration to the adjustable beam.

* * * * *